US006691958B2

(12) United States Patent
Biagiotti

(10) Patent No.: US 6,691,958 B2
(45) Date of Patent: Feb. 17, 2004

(54) SWITCH MACHINE

(75) Inventor: Maurizio Biagiotti, Pisa (IT)

(73) Assignee: General Electric Company, Schenectady, NY (US)

( * ) Notice: Subject to any disclaimer, the term of this patent is extended or adjusted under 35 U.S.C. 154(b) by 7 days.

(21) Appl. No.: 10/099,595

(22) Filed: Mar. 14, 2002

(65) Prior Publication Data

US 2002/0148932 A1 Oct. 17, 2002

(30) Foreign Application Priority Data

Mar. 27, 2001 (IT) ..... FI2001U028

(51) Int. Cl.[7] ..... E01B 7/00

(52) U.S. Cl. ..... 246/415 R; 246/452; 246/476; 246/221

(58) Field of Search ..... 246/220, 257, 246/476, 162, 253, 449, 430, 452, 415 R, 450, 453, 393, 120, 121, 176, 274, 275, 276, 382, 387, 389, 358, 221, 225, 448

(56) References Cited

U.S. PATENT DOCUMENTS 4,093,163 A * 6/1978 Larsson ..... 246/476
5,620,156 A * 4/1997 Berggren et al. ..... 246/221
5,806,809 A 9/1998 Danner
6,149,106 A * 11/2000 McQuistian ..... 246/220
6,158,698 A 12/2000 Click et al.
6,464,177 B1 * 10/2002 Heim ..... 246/453

FOREIGN PATENT DOCUMENTS

EP 467865 A1 * 1/1992 ..... B61L/5/10
IT 01246656 1/1991

* cited by examiner

*Primary Examiner*—S. Joseph Morano
*Assistant Examiner*—Frantz F. Jules
(74) *Attorney, Agent, or Firm*—Gerald W. Spinks

(57) ABSTRACT

A switch machine for a railroad switch provided with two switch points interconnected by transverse bars, including a fixed housing mounted between the switch points; two operating rods extending from the housing to the switch points; a shifting body within the housing, capable of sliding relative to the housing to simultaneously displace the operating rods; a control rod to displace the shifting body between two end stroke points; and engagement device within the housing for selectively engaging the operating rods to the housing at the two end stroke points.

20 Claims, 5 Drawing Sheets

SWITCH MACHINE

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention is in the field of railroad switching devices, namely the equipment which is used to displace railroad switch points. More specifically, the invention refers to a switching device for use with interconnected railroad switch points.

2. Background Art

A railroad switch point consists of tapered rail sections which are capable of being selectively displaced between two different positions at a rail switch and then locked in the selected position, in order to facilitate the desired routing of a train passing through the switch. The two switch points are typically displaced by rods extending from an assembly which is referred to herein as a "switch machine". Inside the switch machine the rods are usually connected to a motive mechanism which provides reciprocating rectilinear motion, controlled by a power unit which is usually placed to one side of the rails.

Such a device is described in Italian Patent No. IT1246656, to the inventor herein. The device described in that patent operates switch points which are independent, or disconnected, from each other, and it is not applicable to the problem of operating switch points of the interconnected type, i.e. of switch points connected to each other by transverse bars. Switch machines of the interconnected type are shown, for example, in U.S. Pat. Nos. 5,806,809 and 6,149,106.

Among the features of the present invention is the provision of an improved switch machine for the selective displacement of interconnected switch points. A second feature of the present invention is a highly reliable switch machine mechanism. Further features of the device disclosed herein include combining the switch point movement and switch point locking functions into a single mechanism to reduce mechanical complexity, enclosing the mechanism in a weather-proof housing, incorporating sensors and other electrical control components in the housing and locating the housing and operating assembly beneath the switch points and the associated rails.

BRIEF SUMMARY OF THE INVENTION

More particularly, the present invention provides a switch machine for operating a switch having switch points interconnected by one or more transverse bars. The switch includes a fixed housing with an upper plate and a lower guide fixed therein. Two operating rods extend from either side of the fixed housing to the movable switch points, with the rods being capable of longitudinally sliding with respect to the fixed upper plate. A skate inside the housing is capable of sliding with respect to the fixed lower guide. An intermediate shift assembly is mounted to the skate for movement with respect to the fixed lower guide. A control rod is provided to selectively attach to the intermediate shift assembly to displace or stroke the intermediate shift assembly in opposite directions between two end points of the stroke. The machine also includes a first engagement mechanism for selectively engaging the operating rods to the fixed upper plate or to the skate to selectively move the switch points, and a second engagement mechanism for selectively engaging the intermediate shift assembly to the control rod and/or to the fixed lower guide to selectively lock the operating rods and the switch points in a desired position.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
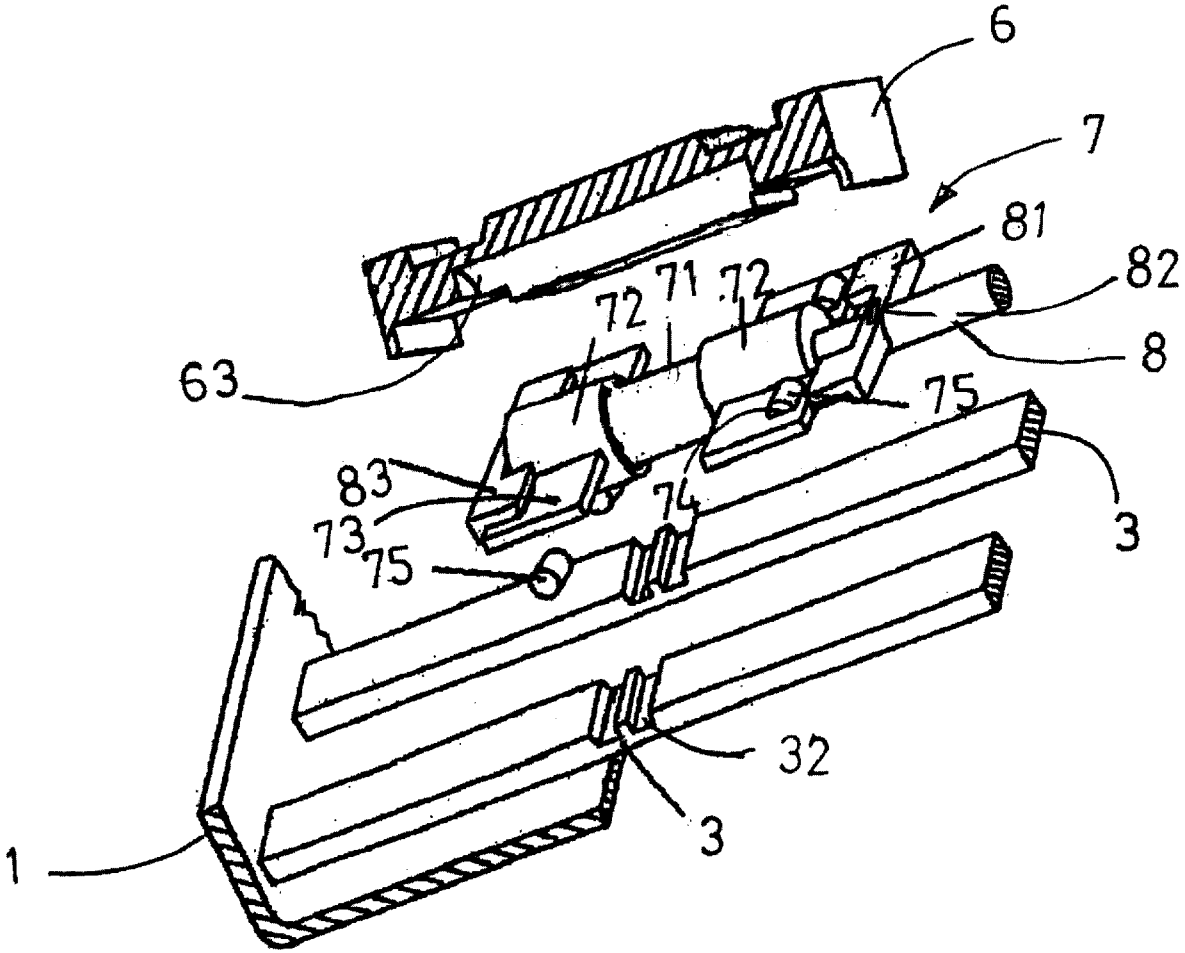
FIG. 1 is an exploded view of the lower components of a switch machine according to the present invention.

As seen in the attached drawings, the switch machine of the present invention includes three basic types of fixed components: a fixed housing 1; a plate 2 fixedly mounted within or otherwise attached to the housing 1; and two guides 3 fixedly mounted within or otherwise attached to the housing 1, below the level of the fixed upper plate 2. A capture mechanism, including a plurality of capture elements and a shifting body, is used to selectively engage and disengage two operating rods 4, 5 to and from the fixed upper plate 2. More specifically, an upper set of interlocking or capture elements are provided to selectively interlock or engage the two operating rods 4, 5 with either the fixed upper plate 2 or the shifting body within the housing 1. As part of the upper set of interlocking elements, the fixed upper plate 2 is provided with two ball seats 24 mounted on the upper side thereof. Each of the ball seats 24 houses a corresponding disk or follower plate 21 which can be completely inserted in its respective ball seat 24 against the action of spring 22. A lower set of interlocking elements are also provided to selectively interlock the shifting body with either the two fixed lower guides 3 or a control rod 8. As part of the lower set of interlocking elements, each of the two fixed lower guides 3 is provided with two transverse pin seats 32, with each pin seat 32 having sloping walls.

The movable components of the present invention include the two operating rods 4, 5 which slidingly contact the lower side of the fixed plate 2, and which move the two switch points A1, A2 transversely. The switch points A1, A2 are connected by one or more transverse bars 9, so that the switch points A1, A2 always move together and maintain their transverse spacing. The switch points A1, A2 can move so that they contact either of two stock rails C1, C2 for the purpose of directing a passing rail car along the desired track. Each operating rod 4, 5 is provided with a through hole 41, 51 sized to allow a ball 42 to pass therethrough, with each ball 42 being sized to pass into one of the ball seats 24. The thickness of each operating rod 4, 5 in the vicinity of its respective through hole 41, 51 is at least half the diameter of the ball 42. One skilled in the art will recognize that a pin of suitable configuration could be used instead of the ball 42, and it could pass through corresponding shaped slots instead of the through holes 41, 51, without departing from the concept of the present invention.

The shifting body within the housing 1 includes a skate 6 and an intermediate shift assembly 7. The skate 6, which slidingly contacts the lower sides of the operating rods 4, 5 is provided with two ball slots 61, 62 recessed into its upper surface, oriented transverse to the longitudinal axis of the skate 6. The wall of each ball slot 61, 62 closest to the center of the skate 6 slopes upwardly toward the center. Each ball slot 61, 62 is able to accept one of the balls 42, with the depth of the ball slot 61, 62 being no more than half the diameter of the ball 42. On the lower side of the skate 6 a semi-cylindrical lower central cavity 63 is provided, with the axis of the semi-cylindrical cavity 63 being parallel to the longitudinal axis of the skate 6. Two transversely oriented stabilizing recesses 65 are provided in the lower side of the skate 6, one stabilizing recess 65 being positioned beyond each end of the central cavity 63. Each stabilizing recess 65 is capable of housing one transversely oriented, cylindrical, end stroke stabilizing pin 66.

The intermediate shift assembly 7 is positioned in contact with the lower side of the skate 6, with the longitudinal axis of the shift assembly 7 parallel to the longitudinal axis of the skate 6. The shift assembly 7 includes a hollow central cylinder 71, provided with a cylindrical sleeve 72 fixedly surrounding each end of the central cylinder 71. Each sleeve 72 has two symmetrical wings 73 extending radially therefrom, transverse to the longitudinal axis of the soft assembly 7. The upper portion of the central cylinder 71 and the cylindrical sleeves 72 of the shift assembly 7 can be securely inserted into the central cavity 63 on the lower side of the skate 6. The symmetrical wings 73 rest flat on the upper sides of the fixed guides 3, with the lower portions of the central cylinder 71 and the cylindrical sleeves 72 positioned between the fixed guides 3. Through slots 74 are provided in each of the wings 73, through which transversely oriented, cylindrical, shift pins 75 can pass in order to seat in the pin seats 32 in the upper sides of the fixed guides 3.

The control rod 8, controlled by an external power unit not shown in the drawings, enters the housing 1 from one side. The control rod 8 can slide through the whole shift assembly 7, and it is provided with U-shaped right and left shift forks 81, 83 straddling the outer ends of the sleeves 72. The shift forks 81, 83 are fixedly mounted on, or integral with, the control rod 8, and they can partially slide over the tops of the wings 73 of the shift assembly 7. On the upper surface of each of the forks 81, 83 an approximately semi-cylindrical transverse groove 82 is provided, to receive the stabilizing pins 66 which are housed in the stabilizing recesses 65 in the lower side of the skate 6.

An external power unit (not shown) can be provided outside the rails, and mounted to one side of the housing 1, with a drive shaft, as is known in the art, passing under the rails and connected to the control rod 8 for achieving bi-directional longitudinal movement of the control rod 8.

Figures 2, 3:
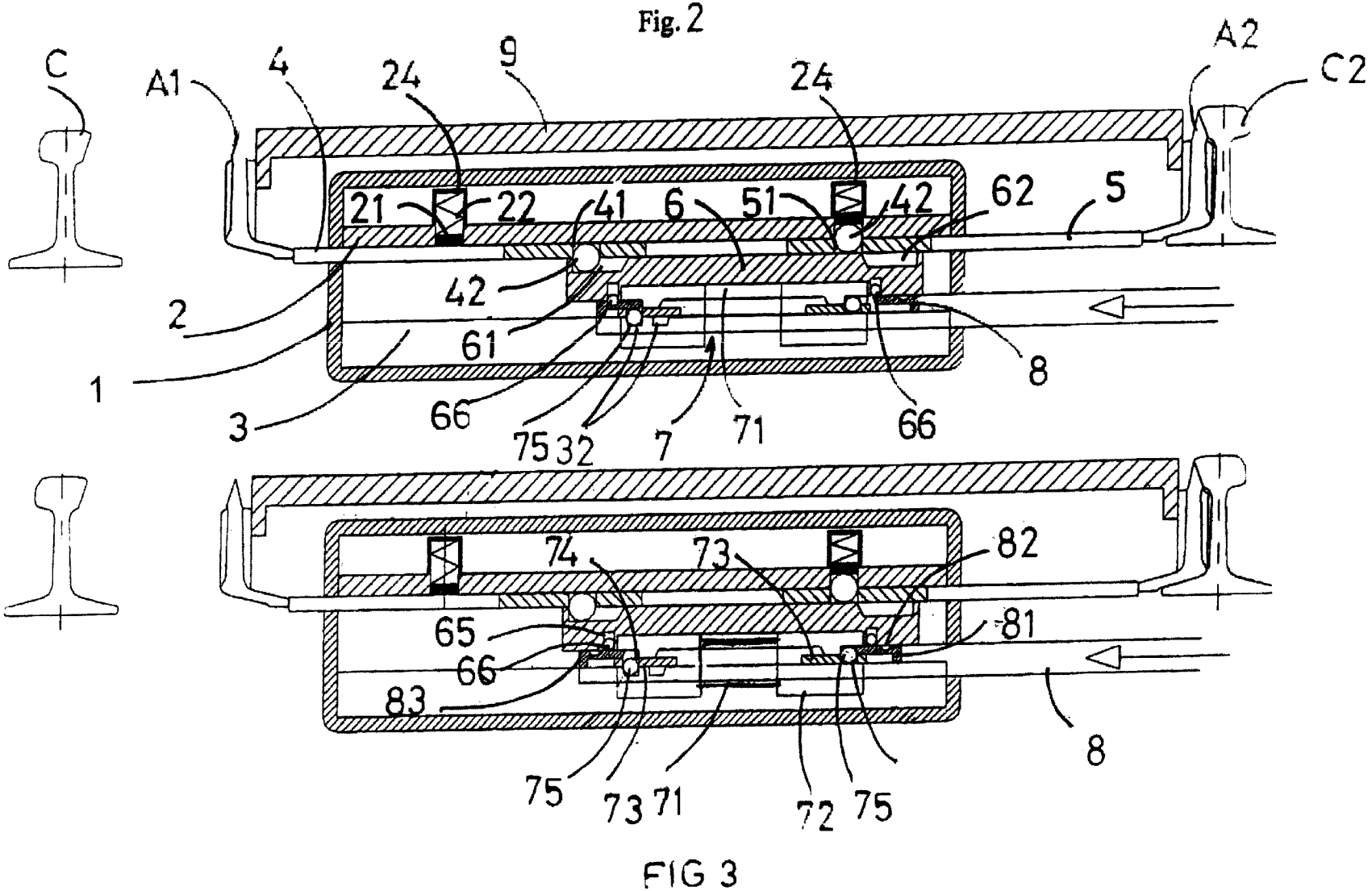
FIG. 2 shows the switch mechanism holding the switch points in the full right position in the locked mode.
FIG. 3 shows the switch machine in the full right position of FIG. 2, but with the control rod moved to the left to unlock the switch machine to move the switch points.

In FIGS. 2 to 6, the sequential steps of the normal functioning of the switch machine are illustrated, and the relative positions of the switch machine components are shown. In FIG. 2, the right switch point A2 is in contact with the right stock rail C2 at the full right end position of the stroke, and the control rod 8 is stabilized relative to the skate 6 by the left end stroke stabilizing pin which is seated in the groove 82 on top of the left fork 83 and partially housed in the left stabilizing recess 65 in the lower side of the skate 6. In this position, the right operating rod 5 is captured relative to the fixed plate 2 by the right ball 42, which is partially housed by the right through hole 51 in the rod 5 and partially housed in the right ball seat 24 of the plate 2. Of course, because of the rigid connection between the switch points A1, A2 effected by the transverse bar 9, the left operating rod 4 is also held in place relative to the fixed plate 2. Therefore, in the configuration shown in FIG. 2, the switch points A1, A2 are held in place at the right end of the stroke. Further, in this configuration, the shift assembly 7 is captured or latched relative to the fixed guides 3 by the left shift pins 75, which are partially housed in the through slots 74 in the left wings 73, partially housed in the left pin seats 32 of the fixed guides 3, and held in place by the left fork 83 extending over the though slots 74. This latching prevents any movement of the shift assembly 7, such as might be caused by vibration, in order to lock the switch machine in this position.

When it is desired to move the switch points A1, A2 from the right end position toward the left end position, movement of the control rod 8 toward the left part of the drawing, as indicated by the arrow in FIG. 2, is caused by the aforementioned power unit. This movement of the control rod 8 first forces the left end stroke stabilizing pin 66 upwardly out of the left semi-cylindrical groove 82 into the left recess 65, allowing the control rod 8 to move leftward. In FIG. 3, shortly after this movement toward the left is initiated, it can be seen that the inner edge of the right fork 81 is abutting the right shift pins 75 which in turn exert a force to the left on the left walls of the through slots 74 in the right wings 73 of the assembly 7. Further, the region over each left shift pin 75 is cleared by the displacement of the left fork 83 toward the left. It is at this point that the shift assembly 7 and the skate 6 are unlatched, and they can begin to move to the left relative to the fixed guide 3, in response to the force exerted by the right fork 81. Because of the extended length of the left ball slot 61, the control rod 8, the skate 6, and the shift assembly 7 can all move to the left relative to the left operating rod 4, even though the right ball 42 is still capturing the right operating rod 5 in place. As the shift assembly 7 moves to the left, the left shift pins 75 are pushed up the sloping left walls of the left pin seats 32 by the right walls of the through slots 74 in the left wings 73, until the shift assembly 7 is completely disengaged from the fixed guides 3.

Figure 4:
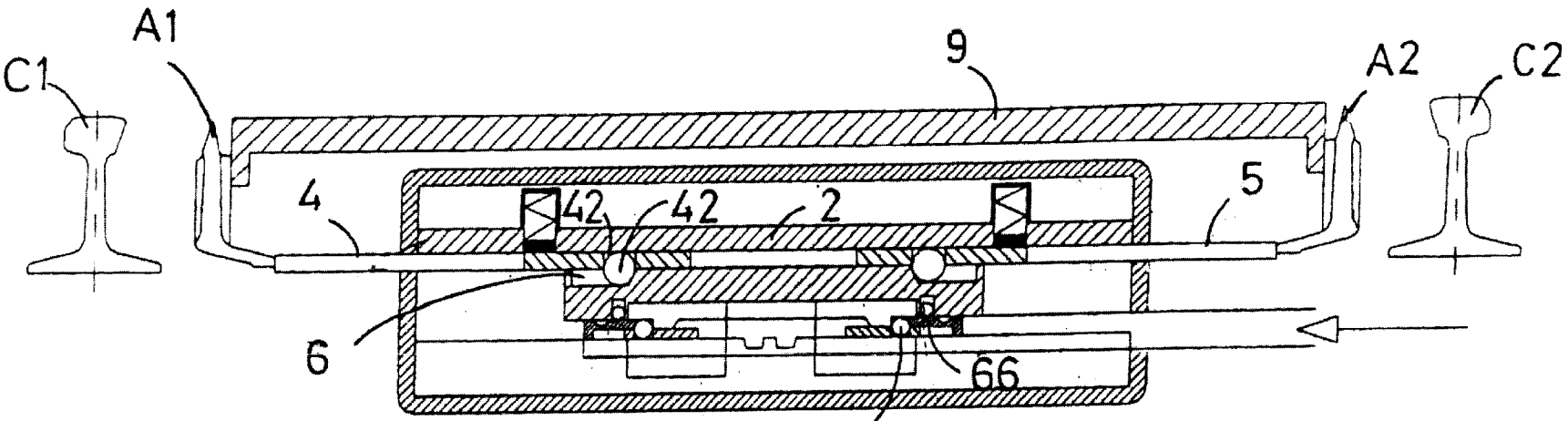
FIG. 4 shows the switch machine with the control rod moved further to the left to move the switch points from the full right position toward the full left position.

As the control rod 8 continues to move to the left, the right fork 81 pushes the shift assembly 7 and the skate 6 to the left, with respect to the operating rods 4, 5, with the result that the right ball 42 is eventually expelled, by gravity and the spring 22, from the right ball seat 24 into the right ball slot 62 in the upper side of the skate 6. This releases the right operating rod 5 from the fixed plate 2; at the same time, the left ball 42 runs along the whole length of the left ball slot 61 on the skate 6. This sequence of movements, all initiated by the movement of the control rod 8 to the left, has the effect of unlocking the operating rods 4, 5, the transverse bar 9, and the switch points A1, A2 for movement to their respective left positions. Continued leftward movement of the control rod 8, the shift assembly 7, and the skate 6 pushes the left operating rod 4 to the left, because of the left ball 42 being abutted by the right wall of the left ball slot 61 and captured in the left ball slot 61 by the fixed plate 2. This configuration is shown in FIG. 4. Leftward movement of the operating rods 4, 5 continues in this way, displacing the left switch point A1 and, in turn, the right switch point A2, which is connected to the left switch point A1 by the transverse bar 9. The switch points A1, A2 are thus moved away from the full right position and toward the left position.

Figure 5:
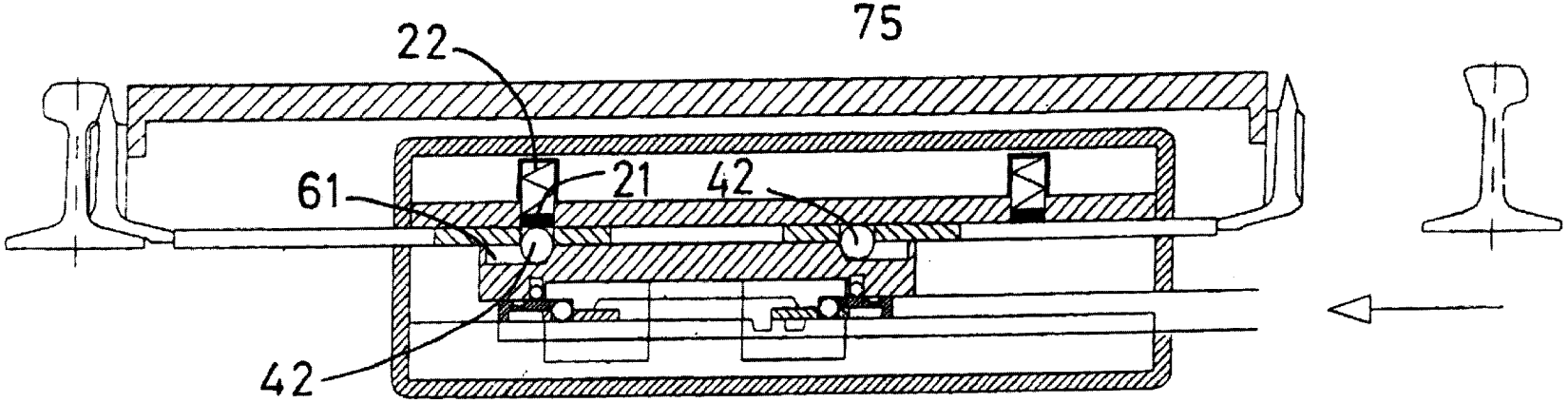
FIG. 5 shows the switch points moved to the full left position.

As seen in FIG. 5, leftward movement has continued until the left switch point A1 abuts the left stock rail C1, and the left ball 42 is positioned directly under the left disk 21 and the left ball seat 24. This positions the operating rods 4, 5 in their full left position.

Figure 6:
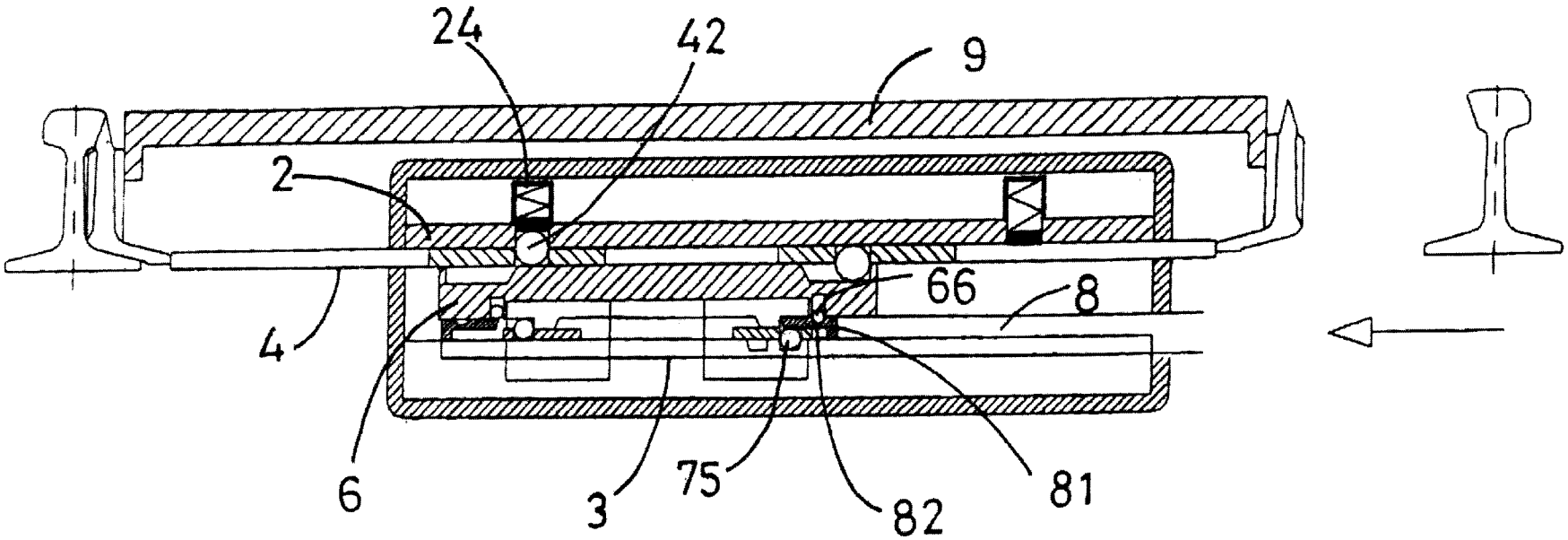
FIG. 6 shows the switch machine locked and latched in its full left position.

At this left end point of the operating rods 4, 5, continued leftward movement of the control rod 8 causes the left ball 42 to be forced upwardly against the disk 21, because of the slope of the right wall of the left ball seat 61 and resistance to further movement of the ball 42 by the left side of the through hole 41. As the left ball 42 is forced upwardly, it compresses the spring 22, until the left ball 42 enters the left ball seat 24 as shown in FIG. 6. Once the left ball 42 rises at least partially into the left through hole 41, it creates an interference which prevents the operating rods 4, 5 from moving farther relative to the fixed plate 2. However, the operating rod 8, the skate 6, and the shift assembly 7 can continue moving to the left because of the extended length of the right ball slot 62, until the right shift pins 75 engage the shift assembly 7 with the right pin seats 32 in the fixed guides 3.

The assembly made of the operating rods 4, 5, the transverse bar 9, and the switch points A1, A2, is also then captured relative to the fixed plate 2 by the left ball 42. At this point, the right shift pins 75 have aligned with, and dropped into, the right pin seats 32 in the fixed guides 3. Also, the right ball 42 has completed its displacement along the right ball slot 62, and it now abuts the right wall of the right ball slot 62. This abutment of the right ball 42 with the right wall of the right ball slot 62 has stopped the leftward movement of the skate 6 and the shift assembly 7 relative to the fixed plate 2. However, the control rod 8 and the forks 81, 83 have continued to move leftward until the right shift pins 75 are captured within the right pin seats 32 of the fixed guides 3 by the right fork 81, securely latching or capturing the shift assembly 7 and the skate 6 relative to the fixed guides 3. Further, the right end stroke stabilizing pin 66 has dropped partially into the groove 82 on top of the fork 81, stabilizing the control rod 8 relative to the skate 6. This locks and latches the switch machine at the full left end of its stroke.

It can be seen that, in this locked and latched configuration, the control rod 8 is not affected by possible loads which may be exerted on the detached right switch point A2. Such loads are transmitted to the switch point A1 via the transverse bar 9, and to the operating rod 4, and they are then absorbed by the plate 2, to which the left operating rod 4 is captured. Furthermore, since the right fork 81 captures the right shift pins 75 in the right pin seats 32, this prevents accidental shifting of the switch machine, which could be caused, for example, by vibrations.

Shifting of the mechanism back to the right is accomplished in a similar fashion to the leftward shifting.

According to another aspect of the invention, electrical sensors incorporated in locations in the mechanism such as the forks 81, 83 act to monitor the correct or incorrect positioning of the mechanism at the right and left end points of its stroke. That is, as can readily be seen from FIG. 2, an electrical sensor in the left fork 83 senses attainment of its rightmost position relative to the left operating rod 4, at the right end point of the stroke of the switch machine. Similarly, as can readily be seen from FIG. 6, an electrical sensor in the right fork 81 senses attainment of its leftmost position relative to the right operating rod 5, at the left end point of the stroke of the switch machine. These sensors may be any suitable sensor such as shown for example in U.S. Pat. No. 6,149,106 and may be engageable with the forks 81, 83 and the operating rods 4, 5. Alternatively, the sensors may be mounted elsewhere within the switch machine so as to sense the position of one element relative to another element within the switch machine.

Figure 7:
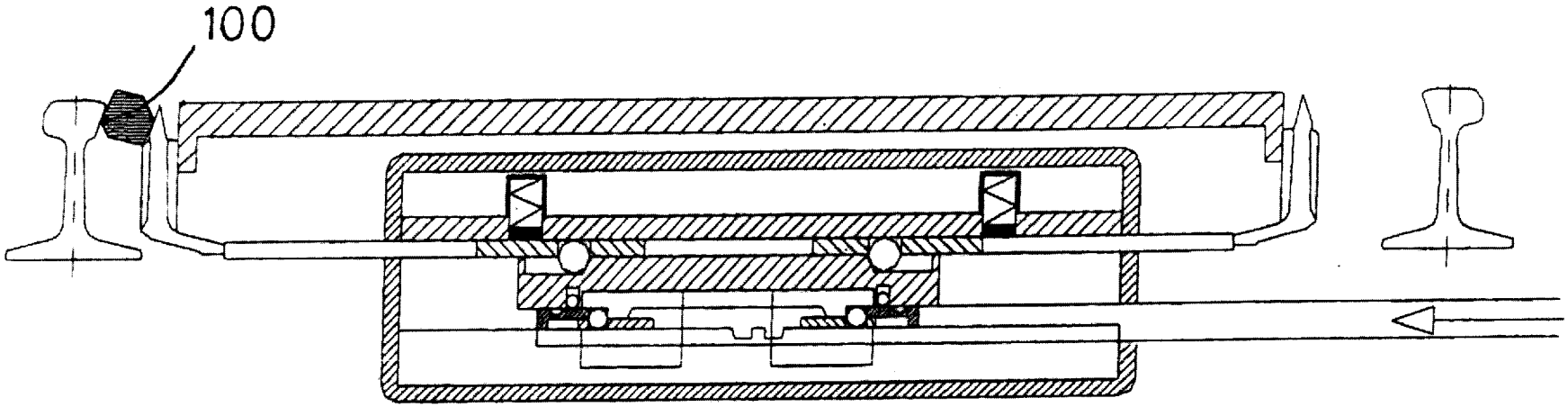
FIG. 7 shows the functioning of the switch machine in the event of blockage preventing movement to its full left position.

In FIG. 7, a first type of irregular functioning of the switch machine is illustrated, where an obstacle 100 between the left switch point A1 and the left stock rail C1 has prevented the full displacement of the switch point A1 to abut the left stock rail C1. The obstacle 100 causes the switch point A1 to stop advancing, and the displacement of the control rod 8 can not reach the predetermined end-stroke point. It can be seen that a sensor in the right fork 81 will readily indicate that the control rod 8 has not reached the end of its stroke relative to the operating rods 4, 5, so that this type of irregular condition is made evident. This irregular functioning may then be communicated to associated wayside signalling equipment or remotely to a data center communicating with the switch.

Figure 8:
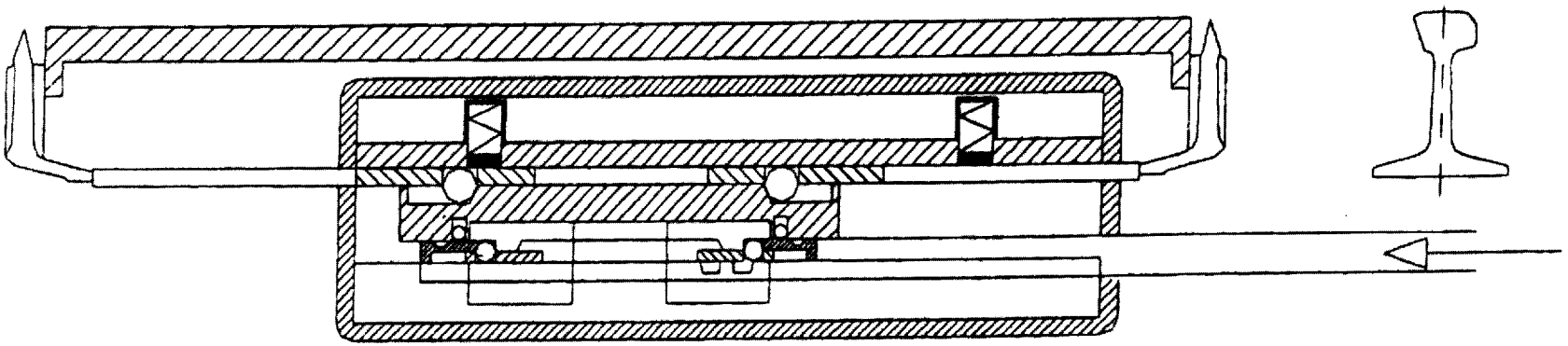
FIG. 8 shows the functioning of the switch machine in the event of the displacement of the left rail preventing engagement by the left switch point in its full left locked position.

In FIG. 8, a second type of irregular functioning is caused by the absence of the stroke rail C1 in the correct position. In that case, the displacement of the switch point A1 is not opposed by the stock rail C1; therefore, the left side of the left through hole 41 never offers sufficient resistance to the movement of the left ball 42 to cause the left ball 42 to react against the sloped wall of the left ball slot 61 and move upwardly, compressing the spring 22 and entering the left ball seat 24. Therefore, the skate 6 is not released from its engagement with the left operating rod 4, and the operating rods 4, 5 continue to move to the left with the control rod 8. As in the previous example, it can be seen that a sensor in the right fork 81, for example, will readily indicate that the control rod 8 has not reached the end of its stroke relative to the operating rods 4, 5, so that this type of irregular condition is made evident. Such event is then communicated to other wayside equipment or a remote data center.

As can be seen, the described switch machine is highly reliable in any possible condition which can arise either during the normal operation of the device or during abnormal operation.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

I claim:

1. A switch machine for operating a railroad switch provided with two switch points, said switch machine comprising:

a longitudinally rigid transverse bar interconnecting said two switch points;

a housing fixedly mounted between said two switch points;

two operating rods, each one of said operating rods having a first end extending from said fixed housing, each one of said first rod ends being attached directly to one of said two switch points; and a shifting mechanism within said fixed housing, said shifting mechanism being engageable to a second end of each one of said operating rods, said shifting mechanism being adapted to simultaneously shift said operating rods between two locked positions relative to said housing, resulting in simultaneous repositioning of said two switch points.

2. The switch machine recited in claim 1, wherein said shifting mechanism is further adapted to allow movement of said shifting mechanism relative to a first one of said operating rods until said shifting mechanism disengages a second one of said operating rods from a first one of said locked positions, prior to engagement of said shifting mechanism to said first operating rod to move said first operating rod toward engagement with said housing in a second one of said locked positions.

3. The switch machine recited in claim 1, further comprising at least one capture element adapted to selectively engage each of said operating rods to said fixed housing in one of said two locked positions.

4. The switch machine recited in claim 1, further comprising at least one position sensor within said fixed housing generating a signal indicative of the position of said operating rods for controlling the movement of said operating rods.

5. A switch machine for operating a railroad switch provided with two switch points, said switch machine comprising:

a longitudinally rigid transverse bar interconnecting said two switch points;

a housing fixedly mounted between said two switch points;

two operating rods, each one of said operating rods having one end extending horizontally from one of two opposite sides of said fixed housing, each one of said extending rod ends being attached directly to one of said two switch points, said operating rods being simultaneously movable between two locked positions, each one of said operating rod locked positions resulting in a desired positioning of said switch points;

a control rod having one end extending from said fixed housing; and a capture mechanism within said fixed housing, said capture mechanism being adapted to selectively disengage said operating rods from said control rod and engage said operating rods to said housing in either of said two locked positions, and said capture mechanism being adapted to selectively disengage said operating rods from said housing and engage said control rod to said operating rods to simultaneously shift said operating rods between said two locked positions.

6. The switch machine recited in claim 5, wherein said capture mechanism is further adapted to allow movement of said control rod relative to a first one of said operating rods until said capture mechanism disengages a second one of said operating rods from a first one of said locked positions, prior to engaging said control rod to said first operating rod to move said first operating rod toward engagement with said housing in a second one of said locked positions.

7. The switch machine recited in claim 5, wherein said capture mechanism is further adapted to selectively engage said control rod to said fixed housing in either of two latched positions, each one of said latched positions of said control rod resulting in positioning of said operating rods in one of said operating rod locked positions.

8. The switch machine recited in claim 7, wherein said capture mechanism is further adapted to allow continued movement of said control rod relative to a first one of said operating rods after a second one of said operating rods is engaged with said housing in one of said locked positions, until said capture mechanism engages said control rod with said housing in one of said latched positions.

9. The switch machine recited in claim 7, further comprising at least one position sensor generating a signal indicative of the positioning of said control rod in said two latched positions for controlling the movement of said control rod.

10. The switch machine recited in claim 5, wherein said capture mechanism comprises:

a shifting body slidably mounted within said fixed housing, said shifting body being movable between two latched positions;

at least one operating rod capture element, said at least one operating rod capture element being adapted to selectively disengage said operating rods from said shifting body and engage said operating rods to said fixed housing in either of said two locked positions, and said at least one operating rod capture element being adapted to selectively disengage said operating rods from said fixed housing and engage said shifting body to said operating rods to simultaneously shift said two operating rods between said two locked positions; and at least one shifting body capture element, said at least one shifting body capture element being adapted to selectively disengage said shifting body from said control rod and engage said shifting body to said fixed housing in either of said two latched positions, and said at least one shifting body capture element being adapted to selectively disengage said shifting body from said fixed housing and engage said control rod to said shifting body to shift said shifting body between said two latched positions.

11. The switch machine recited in claim 10, wherein said at least one operating rod capture element is further adapted to allow movement of said shifting body relative to a first one of said operating rods until said at least one operating rod capture element disengages a second one of said operating rods from said housing in a first one of said locked positions, prior to said at least one operating rod capture element engaging said shifting body to said first operating rod to move said first operating rod toward engagement with said housing in a second one of said locked positions.

12. The switch machine recited in claim 10, wherein said at least one operating rod capture element is further adapted to allow continued movement of said shifting body relative to a first one of said operating rods while a second one of said operating rods is engaged with said housing in one of said locked positions, until said at least one shifting body capture element engages said shifting body with said housing in one of said latched positions.

13. The switch machine recited in claim 10, wherein said shifting body comprises:

a skate adapted to be selectively engaged to, and disengaged from, said operating rods by said at least one operating rod capture element; and a shift assembly adapted to attach to said skate, said shift assembly being adapted to be selectively engaged to, and disengaged from, said control rod and said fixed housing by said at least one shifting body capture element.

14. The switch machine recited in claim 10, wherein said at least one operating rod capture element comprises at least one detent mechanism.

15. The switch machine recited in claim 10, wherein said at least one shifting body capture element comprises at least one detent mechanism.

16. The switch machine recited in claim 10, further comprising:

a horizontal plate fixedly mounted within said fixed housing; and a horizontal guide fixedly mounted within said fixed housing, below said fixed plate;

wherein said shifting body is slidably mounted between said fixed plate and said fixed guide;

wherein said operating rods are selectively engaged to said fixed housing by being engaged to said fixed plate; and wherein said shifting body is selectively engaged to said fixed housing by being engaged to said fixed guide.

17. The switch machine recited in claim 16, wherein:

said shifting body comprises:

a skate adapted to be selectively engaged to, and disengaged from, said operating rods by said at least one operating rod capture element; and a shift assembly adapted to attach to said skate, said shift assembly being adapted to be selectively engaged to, and disengaged from, said control rod and said fixed housing by said at least one shifting body capture element; and said at least one operating rod capture element is further adapted to allow movement of said skate relative to a first one of said operating rods until said at least one operating rod capture element disengages a second one of said operating rods from said fixed plate in a first one of said locked positions, prior to said at least one operating rod capture element engaging said skate to said first operating rod to move said first operating rod toward engagement with said fixed plate in a second one of said locked positions.

18. The switch machine recited in claim 16, wherein:

said shifting body comprises:

a skate adapted to be selectively engaged to, and disengaged from, said operating rods by said at least one operating rod capture element; and a shift assembly adapted to attach to said skate, said shift assembly being adapted to be selectively engaged to, and disengaged from, said control rod and said fixed housing by said at least one shifting body capture element; and said at least one operating rod capture element is further adapted to allow continued movement of said skate relative to a first one of said operating rods while a second one of said operating rods is engaged with said fixed plate in one of said locked positions, until said at least one shifting body capture element engages said shift assembly with said fixed guide in one of said latched positions.

19. A switch machine for operating a railroad switch provided with two switch points, said switch machine comprising:

a longitudinally rigid transverse bar interconnecting said two switch points;

a housing fixedly mounted between said two switch points;

a horizontal plate fixedly mounted within said fixed housing; and a horizontal guide fixedly mounted within said fixed housing, below said fixed plate;

a shifting body mounted between said fixed plate and said fixed guide, said shifting body being movable between two latched positions;

two operating rods, each one of said operating rods having one end extending horizontally from one of two opposite sides of said fixed housing, each one of said extending rod ends being attached directly to one of said two switch points, said operating rods being simultaneously movable between two locked positions, each one of said operating rod locked positions resulting in a desired positioning of said switch points;

a control rod having one end extending from said fixed housing; and at least one operating rod capture element, said at least one operating rod capture element being adapted to selectively disengage said operating rods from said shifting body and engage said operating rods to said fixed plate in either of said two locked positions, and said at least one operating rod capture element being adapted to selectively disengage said operating rods from said fixed plate and engage said shifting body to said operating rods to simultaneously shift said two operating rods between said two locked positions; and at least one shifting body capture element, said at least one shifting body capture element being adapted to selectively disengage said shifting body from said control rod and engage said shifting body to said fixed guide in either of said two latched positions, and said at least one shifting body capture element being adapted to selectively disengage said shifting body from said fixed guide and engage said control rod to said shifting body to shift said shifting body between said two latched positions.

20. The switch machine recited in claim 19, wherein:

said at least one operating rod capture element is further adapted to allow movement of said shifting body relative to a first one of said operating rods until said at least one operating rod capture element disengages a second one of said operating rods from said fixed plate in a first one of said locked positions, prior to said at least one operating rod capture element engaging said shifting body to said first operating rod to move said first operating rod toward engagement with said fixed plate in a second one of said locked positions; and said at least one operating rod capture element is further adapted to allow continued movement of said shifting body relative to a first one of said operating rods while a second one of said operating rods is engaged with said fixed plate in one of said locked positions, until said at least one shifting body capture element engages said shifting body with said fixed guide in one of said latched positions.

* * * * *